US005803173A

United States Patent [19]

Fraser, III et al.

[11] Patent Number: 5,803,173

[45] Date of Patent: Sep. 8, 1998

[54] LINER WIPER PLUG APPARATUS AND METHOD

[75] Inventors: James M. Fraser, III, Spring; Steven W. Stringfellow, Carmine, both of Tex.

[73] Assignee: Baker Hughes Incorporated, Houston, Tex.

[21] Appl. No.: 681,721

[22] Filed: Jul. 29, 1996

[51] Int. Cl.[6] ..... E21B 33/16

[52] U.S. Cl. ..... 166/291; 166/155; 166/317; 166/332.8

[58] Field of Search ..... 166/383, 386, 166/291, 332.8, 155, 317

[56] References Cited

U.S. PATENT DOCUMENTS

| | | | |
|---|---|---|---|
| 2,101,640 | 12/1937 | Chonette et al. | 166/291 |
| 3,087,551 | 4/1963 | Kerver | 166/317 |
| 3,616,850 | 11/1971 | Scott | 166/155 |
| 3,796,260 | 3/1974 | Bradley | 166/153 |
| 4,164,980 | 8/1979 | Duke | 166/291 |
| 4,541,484 | 9/1985 | Salerni et al. | 166/317 X |
| 4,691,775 | 9/1987 | Lustig et al. | 166/317 |
| 4,809,776 | 3/1989 | Bradley | 166/153 |
| 4,842,069 | 6/1989 | Baugh et al. | 166/285 |
| 4,934,452 | 6/1990 | Bradley | 166/153 |
| 5,012,867 | 5/1991 | Kilgore | 166/317 |
| 5,018,579 | 5/1991 | Braddick et al. | 166/291 |
| 5,020,597 | 6/1991 | Braddick et al. | 166/291 |
| 5,036,922 | 8/1991 | Braddick | 166/383 |
| 5,052,488 | 10/1991 | Fraser | 166/285 |
| 5,191,932 | 3/1993 | Seefried et al. | 166/291 |
| 5,392,852 | 2/1995 | Laurel et al. | 166/153 |

FOREIGN PATENT DOCUMENTS

94/27026 11/1994 WIPO .

*Primary Examiner*—Hoang C. Dang
*Attorney, Agent, or Firm*—Gerald W. Spinks

[57] ABSTRACT

An apparatus and method are disclosed for pumping segregated fluids through a tubular member, such as is required when cementing a liner into a well bore. A liner wiper plug has an internal bore formed therethrough, with a flapper valve mounted in the liner wiper plug. The flapper valve can pivot to an open position to allow fluid flow through the wiper plug, and the flapper valve can pivot to a closed position to prevent fluid flow through the wiper plug. A work string, or a stinger attached to a work string, can be positioned within the internal bore of the wiper plug, holding the flapper valve in the open position. The wiper plug can be run into the well on the work string, with the flapper valve held open, and with flow of a first fluid in progress. The wiper plug can be releasably supported from the liner. The work string is withdrawn from the wiper plug to allow the flapper valve to close. Pumping a second fluid through the work string to apply fluid pressure to the wiper plug will then release the wiper plug from the liner and force the wiper plug to pass through the liner as desired, segregating the two fluids.

17 Claims, 4 Drawing Sheets

LINER WIPER PLUG APPARATUS AND METHOD

FIELD OF INVENTION

This invention is in the field of apparatus used to segregate fluids being pumped into a well, such as an oil or gas well. Specifically, this invention relates to apparatus for use in pumping cement into a well, to cement a liner into a well.

BACKGROUND OF THE INVENTION

A liner is a tube or pipe which is installed in a well for control of the well, or to reduce the cost of drilling or completing the well. Liners come in various diameters, and they can be installed in an open hole well bore, or in a cased hole. The liner is typically run into the well on a work string and suspended in the well bore by being hung or supported from a casing, by a set of slips. Installing or setting the liner in the well is accomplished by some type of setting tool, which fixes the liner in place and releases it from the work string.

After installation of the liner in the well bore, cement is usually placed between the liner and the outer casing, or between the liner and the bore hole wall. Cement is pumped downhole through the work string into the upper end of the liner, out the lower end of the liner, and back up into the annular space between the liner and the casing or bore hole wall. A one way foot valve is normally located in the lower end of the liner to allow the cement to be pumped out into the annular space, and to prevent cement or other fluids from entering the liner from the bore hole. After the proper amount of cement has been pumped downhole to fill the annular space to the desired depth, a second fluid, such as a drilling fluid, is pumped through the work string to displace the cement from the inner bore of the liner into the annular space. This keeps the liner bore open for subsequent use.

It is desirable to insure that the cement is not mixed with other fluids while being pumped into the annular space. However, the liner is usually full of drilling fluid before the cementing operation begins, and as mentioned above, the cement is eventually displaced from the liner bore by drilling fluid. Therefore, a liner wiper plug is often pumped through the liner in front of the cement, between the cement and the fluid, to displace the drilling fluid from the liner before the cement passes through the liner. When the wiper plug reaches the foot valve, it stops at a position which allows the cement to pass through the foot valve.

After pumping in the cement, a second liner wiper plug is often pumped through the liner behind the cement, when the drilling fluid displaces the cement from the liner bore. In addition to sealing against the liner wall to segregate the fluids, the second wiper plug wipes the walls of the liner during displacing cement from the liner bore. For the purposes of sealing and wiping, the liner wiper plug normally has a compressible sealing element around its outer periphery, to seal against the liner wall. The compressible sealing element is usually made of a pliable elastomer.

The first and second liner wiper plugs are usually similar in design. Sometimes, more than two liner wiper plugs are used to segregate fluids, depending upon the particular application. This technique also can be used in any application, in addition to cementing operations, where segregation of fluids is required.

Regardless of whether single or multiple liner wiper plugs are to be used, they can be run into the well on a work string, either after installation of a liner, or along with the liner. The wiper plugs can be releasably attached to the work string, or to the liner, by a number of different types of mechanisms that are well known in the art. One example is the use of collet fingers on one component, such as the liner, to releasably latch in a groove on the other component, such as the wiper plug. The collet fingers can be released by various means known in the art, such as by shifting a sleeve. Also, shear pins can be used to selectively release a wiper plug by increasing the fluid pressure until the pins shear. Regardless of the application, care is taken to insure that a liner wiper plug is reliably released from the work string to be pumped through the liner at the desired time, and not prematurely.

Since a wiper plug is run into the hole on the work string, and since fluid must be pumped through the plug at various times, the plug typically has an internal bore to allow the fluid to pass through, before release of the wiper plug. When it is necessary to increase fluid pressure against the wiper plug to release the wiper plug, and to force the wiper plug through the liner, the internal bore of the wiper plug must be plugged. This is typically done by releasing a ball or dart of some kind from the surface to fall through the work string to the wiper plug. When the ball or dart falls into the wiper plug, the internal bore of the wiper plug is plugged, and an increase of the fluid pressure will exert a downward force on the wiper plug.

Difficulty arises in some cases when a ball or dart can not be reliably dropped from the surface to settle into the internal bore of the wiper plug. This difficulty can particularly arise when coiled tubing is being used as the work string, and especially if an electrical cable is inside the coiled tubing. Coiled tubing is usually of a smaller diameter than the most commonly used sizes of conventional drill pipe. This smaller diameter makes the passage of a ball or dart less reliable than it would be with conventional drill pipe. Further, coiled tubing is stored and transported on relatively small diameter reels, introducing a continuous bend into the tubing. This bend is removed, for the most part, when the coiled tubing is straightened at the well site, as the tubing is injected into the well. However, some residual bend usually remains in the tubing, causing it to be less straight than conventional drill pipe. As a ball or dart is dropped from the surface of the well site, to pass through the coiled tubing to the wiper plug, this residual bend in the coiled tubing impedes the passage of the ball or dart, at least to some degree. When combined with the effect of the smaller diameter normally found in coiled tubing, the lack of a straight path can be a significant impedance to the passage of the ball or dart.

Finally, it has become increasingly common to perform drilling operations with coiled tubing, while using Measure While Drilling (MWD) equipment near the bottom hole assembly at the lower end of the tubing. Often, the MWD equipment communicates with the surface of the well site by means of an electrical cable which is run through the coiled tubing. Unfortunately, the electrical cable partially obstructs the inner bore of the coiled tubing. When such a cable is inside the coiled tubing, it can be virtually impossible to drop a ball or dart through the coiled tubing. Therefore, when electrical cable is in use with coiled tubing, the operator must pull the tubing out of the well and run the liner wiper plugs on conventional drill pipe, or on cable-free coiled tubing. However, as discussed above, even cable-free coiled tubing can impede the passage of a ball or dart, because of the residual bend and the small diameter.

Also, a capillary tube inside the coiled tubing is sometimes used to hydraulically set downhole tools that are attached to the coiled tubing. This capillary tube would restrict the passage of any balls or darts that might be pumped through the coiled tubing. This requires the pulling of any such tubing before a ball or dart can be deployed.

It would be useful, then, to have a liner wiper plug which can be released without the necessity for dropping a ball or dart from the surface. It would also be useful if the liner wiper plug can be released into the liner by increasing fluid pressure, as is the common practice with known wiper plugs, but without the necessity for dropping a ball or dart from the surface. The object of the present invention is to provide an apparatus, and a method of operation, which will allow a liner wiper plug to be run into a well bore on a work string and set in place in much the same manner as the current the practice, but which will allow the deployment of the liner wiper plug without dropping a ball or dart from the surface, and without pulling the work string from the well.

SUMMARY OF THE INVENTION

The present invention is exemplified by an apparatus, and a method of operation thereof, which consists of a liner wiper plug having an open internal bore, and having a compressible seal on its outer periphery, with a flapper valve pivotably mounted in the wiper plug. The flapper valve can pivot to an open position in which fluid flow can pass through the internal bore of the wiper plug, and it can pivot to a closed position in which fluid flow can not pass through the internal bore. The wiper plug can be releasably attached to a work string of any type, either by means of direct attachment, or by means of being releasably attached to a liner which is in turn attached to the work string. Although perhaps most useful for coiled tubing applications, the present invention can also be used with other delivery systems, such as conventional drill pipe.

Attachment of the wiper plug to the work string or to the liner, and attachment of the liner to the work string, are releasable. Releasable attachment of the liner wiper plug to the work string or liner, or releasable attachment of the liner to the work string, can be by means of any known releasable attachment mechanism, such as with collet fingers, threaded collars, or shear mechanisms. When used with coiled tubing, attachment of the wiper plug to the liner will preferably be by means of a mechanism which can be released by increasing the fluid pressure, by pumping fluid through the work string. This type of attachment can be achieved by the use of one or more shear pins extending radially from the wiper plug to support the wiper plug from a land within the liner. When the flapper valve is in the closed position, fluid pressure above the wiper plug can be increased to shear the shear pin, thereby releasing the wiper plug from the liner.

Various other fluid flow control means could be used in the wiper plug, instead of the flapper valve, without departing from the spirit of the present invention. For instance, a ball could be located in a side passageway to move selectively into the internal fluid flow bore, or an electrically controlled valve could be used in the internal bore. The advantage of the flapper or the ball is that its position can be controlled without the need for electrical equipment. If a flapper or ball is used, various means can be used for positioning the valve in the open position and for causing the valve to move to the closed position. Placement of the work string, or some hollow extension thereof such as a stinger, in the internal bore of the wiper plug can hold the flapper or ball out of the internal bore, thereby allowing fluid flow through the internal bore, via the hollow work string. This position of the flapper or ball is referred to as the open position.

Withdrawing the work string from the internal bore of the wiper plug allows the flapper to pivot to the closed position, thereby blocking the internal bore to fluid flow. Movement of the flapper or the ball into the internal bore can be achieved by the force of gravity, or the flapper or ball can be additionally biased by mechanical means such as a spring. If an electrical valve is used, actuation of the electrical valve to close the internal bore could be achieved by activating a switch by withdrawal of the work string from the internal bore of the wiper plug. The preferred embodiment relies on the gravity driven flapper valve, thereby utilizing the simplest, cheapest, and most reliable mechanism possible.

The liner wiper plug of the present invention is run into the well bore on the work string, either with the liner or after placement of the liner. The liner can be set in place, and released from the work string, by any currently known means. Similarly, if the liner wiper plug is run separately into the liner on a work string, the wiper plug can be put in place and released from the work string by an known means. The wiper plug is supported from the liner by means of the shear pins, which extend radially to engage a land or similar structure in the liner. The work string or stinger is raised until its lower end has retreated far enough from the internal bore of the wiper plug to allow the flapper valve to pivot to the shut position. The pumps are then operated to introduce the desired fluid into the work string, ultimately raising pressure against the top of the wiper plug. When the fluid pressure reaches a sufficient level, the shear pins will shear, deploying the wiper plug into the liner. Pumping continues, and the fluid passes through the liner, preceded by the wiper plug.

It can be seen that multiple plugs can be used to segregate multiple types of fluids. If multiple wiper plugs are used, all of the wiper plugs could be run into the well bore at once, and the shear pins could be selected to shear at progressive force levels, to insure that each of the wiper plugs would be deployed as desired. Incremental withdrawal of the stinger could also be implemented to insure that only one wiper plug is pressurized at a time.

The novel features of this invention, as well as the invention itself, will be best understood from the attached drawings, taken along with the following description, in which similar reference characters refer to similar parts, and in which:

DESCRIPTION OF PREFERRED EMBODIMENTS

Figure 1:
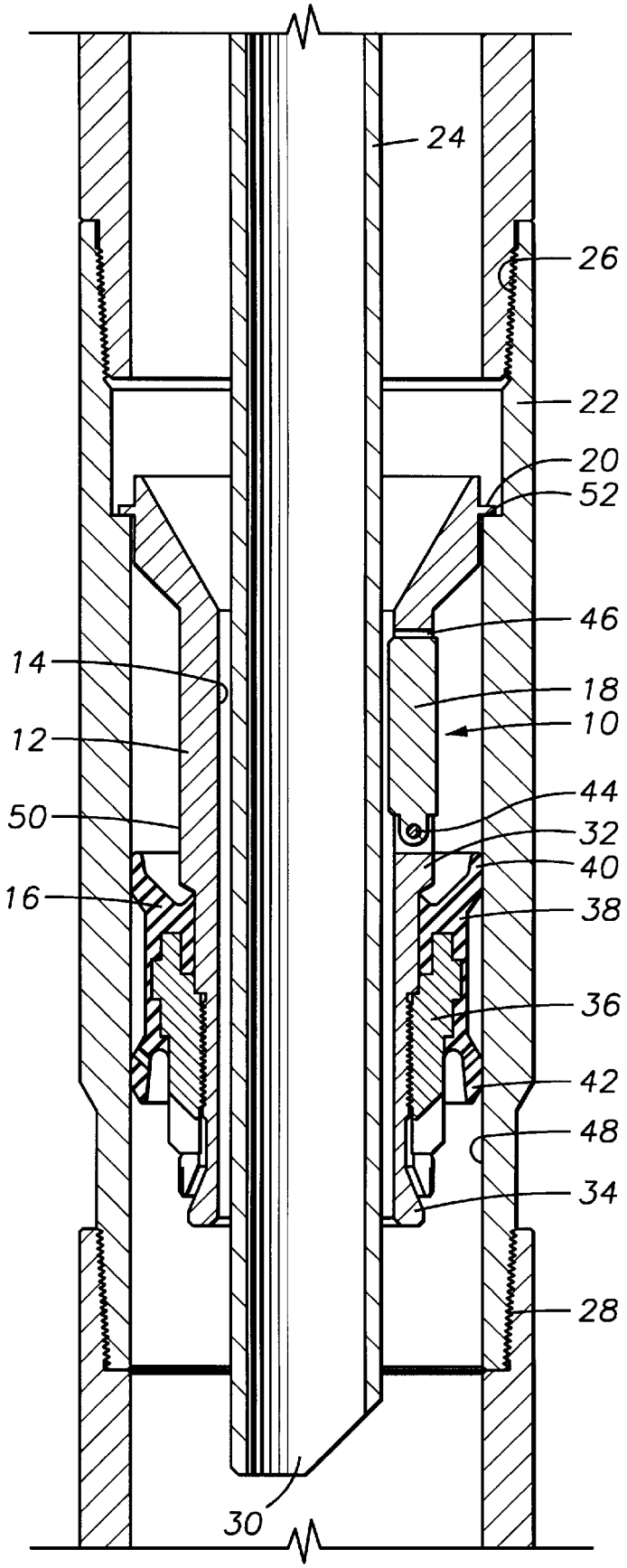
FIG. 1 is a section view of the apparatus of the present invention, showing the work string or stinger inserted through the bore of the wiper plug.
Figure 2:
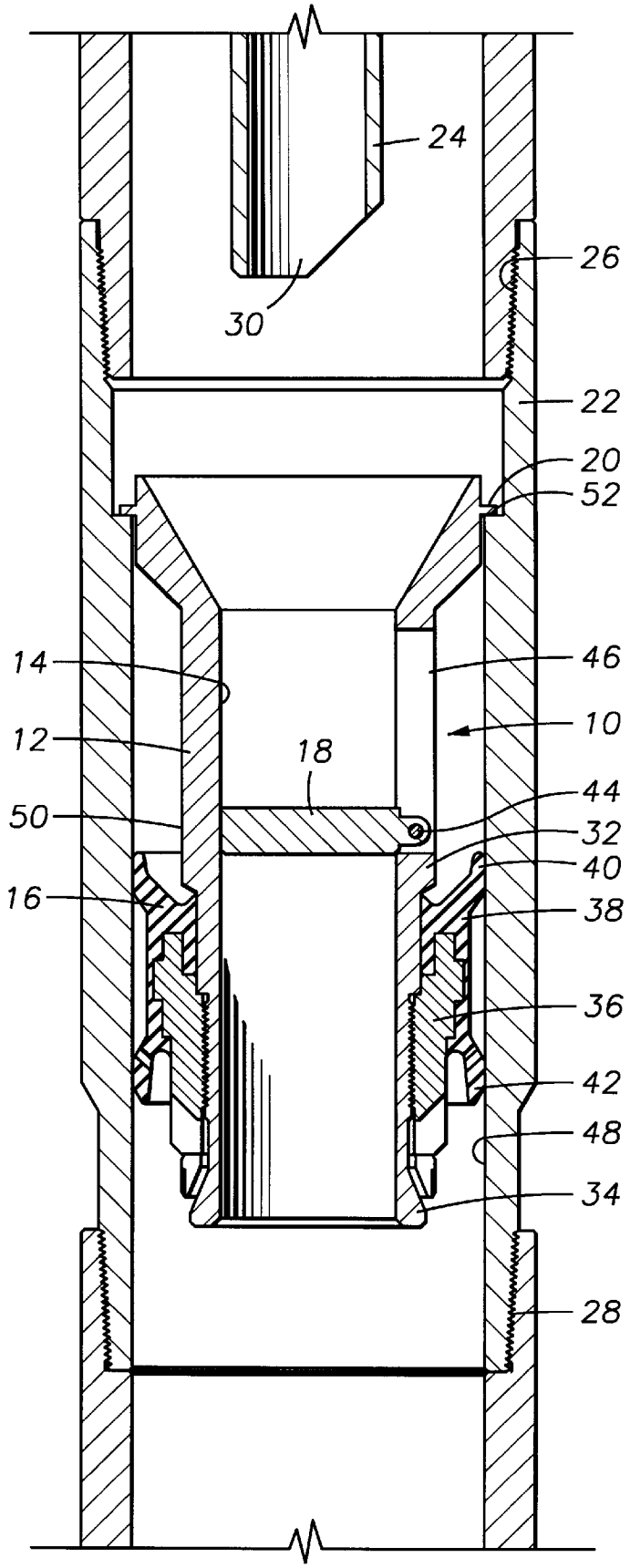
FIG. 2 is a section view of the apparatus of FIG. 1, showing the stinger partially withdrawn from the bore to allow the flapper valve to close.

As shown in FIG. 1, the liner wiper plug 10 of the present invention comprises a plug body 12, with an internal bore 14 passing therethrough, an external sealing element 16 on the outer periphery of the plug body 12, and a two position fluid flow control device 18. The flapper valve 18 which functions as a fluid flow control device in this embodiment has an open position as shown in FIG. 1, and a closed position as shown in FIG. 2. The plug body 12 is a substantially cylindrical rigid body having an outer periphery 50 and an internal bore 14. The plug body 12 can be a single piece, or it can be formed of two or more pieces attached together, such as by threads.

Figure 3:
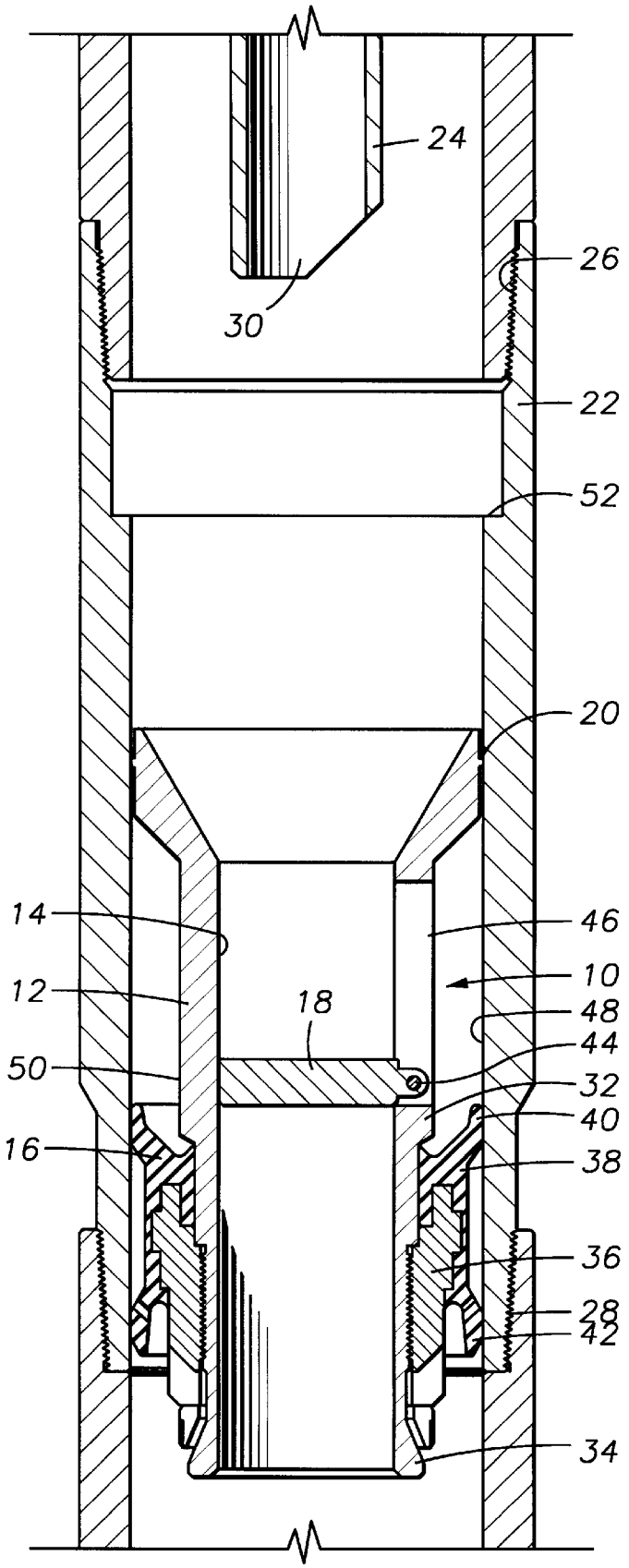
FIG. 3 is a section view of the apparatus of FIG. 1, showing the wiper plug being forced through the liner.

The upper end of the plug body 12 can be flared outwardly as shown to provide a means of supporting the wiper plug 10 from a liner or liner sleeve 22. The liner sleeve 22 is typically threaded at its upper end 26 and its lower end 28 to mate with other liner sections. The outwardly flared upper portion of the plug body 12 has at least one, and preferably several, shear pins or break-off lugs 20. A collet mechanism could be used instead. The shear pins or break-off lugs 20 extend radially outwardly from the flared upper portion of the plug body 12, to releasably support the wiper plug 10 from the liner or liner sleeve 22. An annular land 52, or some similar support structure, is formed in the inner bore 48 of the liner 22. The pins or lugs 20 extend outwardly from the flared upper portion of the plug body 12 to rest upon the annular land 52, and support the liner wiper plug 10 from the land 52. The shear strength of the shear pins or lugs 20 is designed to support the wiper plug 10 from the liner 22 until a selected downward force is applied to the wiper plug 10. When the selected downward force is imposed on the wiper plug 10, the shear pins or lugs 20 are designed to shear, allowing the wiper plug 10 to pass through the liner 22, as shown in FIG. 3.

The flapper valve 18 acts as a fluid flow control device, controlling flow of drilling fluids and other fluids, through the internal bore 14 of the wiper plug 10. The flapper valve 18 is pivotably mounted to the plug body 12, to pivot about a pivot pin 44. When in the open position shown in FIG. 1, the flapper valve 18 is pivoted into a recess or hole 46 in the plug body 12. The flapper valve 18 can be essentially flat, or it can be contoured to pivot completely inside the recess 46. The periphery of the flapper 18 is essentially circular, to substantially match the diameter of the internal bore 14 of the plug body 12.

Figure 4:
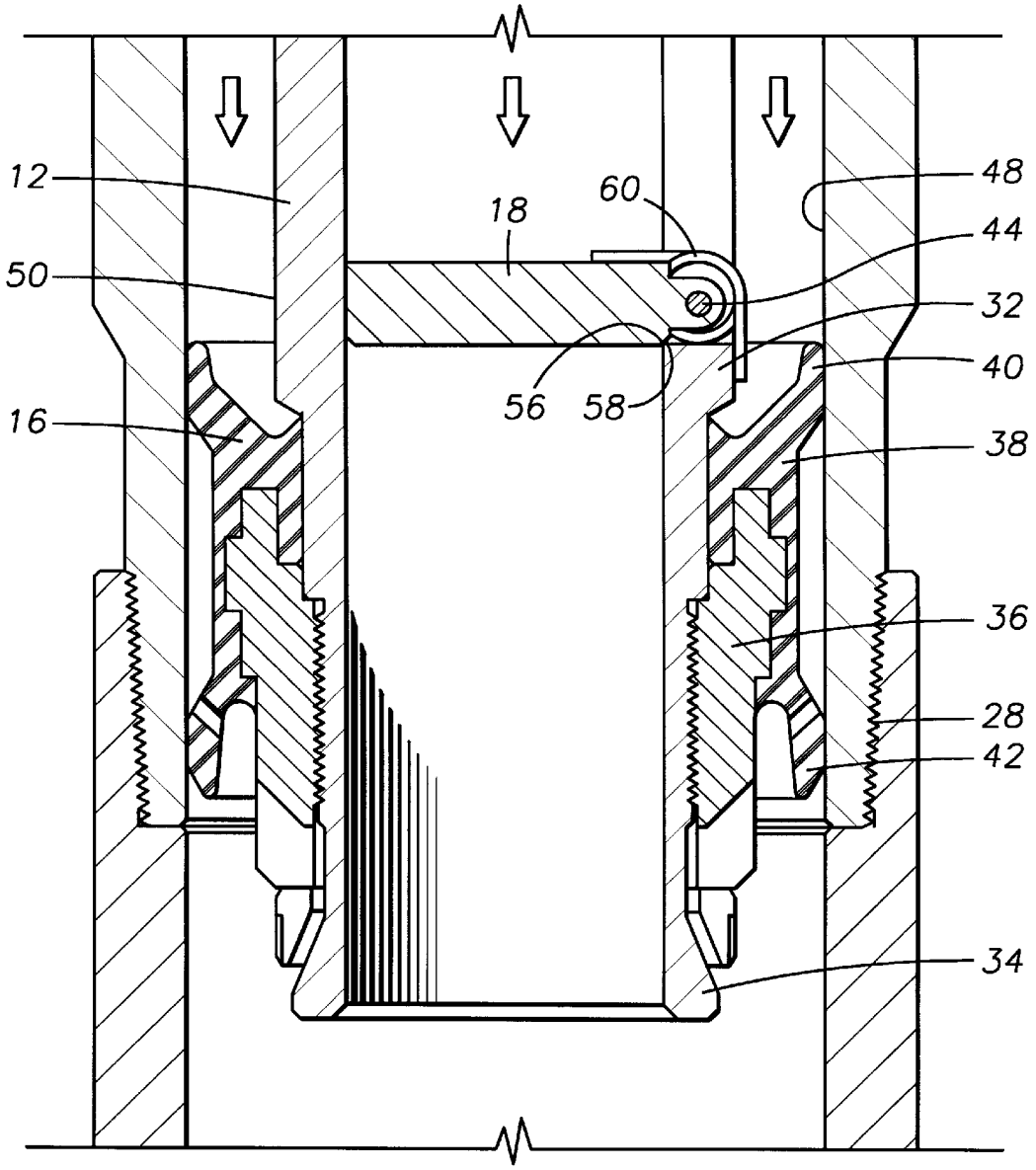
FIG. 4 is a section view of the apparatus of FIG. 1, showing a larger scale view of the flapper valve.

The pivot point of the flapper 18 is selected so as to cause the flapper 18 to tend to pivot from the open position shown in FIG. 1 to the closed position shown in FIG. 2, under the force of gravity. This assumes a substantially vertical orientation of the wiper plug 10, or positioning of the recess 46 on the upper side of the wiper plug 10, if the bore hole is not vertical. As an alternative to gravity operation, a spring 60 can be used to assist in the closing of the flapper valve 18, as shown in FIG. 4.

Other forms of flow control devices not shown could be used without departing from the spirit of the present invention. For example, a ball captured within a secondary bore or passageway could be arranged to fall into the internal bore 14, thereby closing the internal bore 14. As another example, an electrically controlled valve, such as a ball valve, could be positioned in the internal bore 14, to close either automatically, or upon receipt of a signal from an operator.

A stinger 24, or the lower end 30 of a work string, can be inserted through the internal bore 14 of the plug body 12. The wiper plug 10 can be releasably attached to the work string 24 by means of any known releasable attachment device (not shown). Alternatively, the liner sleeve 22 can be releasably attached to the work string 24, and the wiper plug 10 can be supported by the liner sleeve 22. In either case, the work string 24 holds the flapper valve 18 in the open position shown, as long as the work string 24 is positioned through the internal bore 14. If used instead of the flapper valve, an electromechanical valve could be activated by a switch which reacts to the position of the stinger 24. A purely mechanical valve of almost any design could be activated to close in response to withdrawal of the stinger 24, in the same way as the flapper valve 18, which will be explained below. The work string 24 supports the liner sleeve 22 and the liner wiper plug 10 during installation of the liner sleeve 22 and the wiper plug 10 in the well bore. Alternatively, the wiper plug 10 can be installed in a liner or liner sleeve 22 which is already in place in the well bore.

The sealing element 16 is mounted to an intermediate portion 32 of the plug body 12, on the outer periphery 50 of the plug body 12. The lower portion 34 of the plug body 12 can have various structures for releasable attachment to other wiper plugs which may be used in conjunction with the present apparatus. When the wiper plug 10 is in place in the liner sleeve 22, the sealing element 16 seals the space between the plug body 12 and the inner bore 48 of the liner sleeve 22. The sealing element 16 comprises a substantially cylindrical rigid seal body 36 and a compressible seal 38. The seal body 36 can be attached to the plug body 12 by means such as threads. The compressible seal 38 can be constructed of a compressible sealing material such as an elastomer. The compressible seal 38 can be formed on the rigid seal body 36 by being molded thereon or bonded thereto. The compressible seal 38 has an annular upper lip 40 and an annular lower lip 42. When in the relaxed state, the upper and lower annular lips 40, 42 extend radially outwardly to a diameter greater than the diameter of the inner bore 48 of the liner sleeve 22. The upper and lower annular lips 40, 42 are sized and shaped so as to flex radially inwardly when the wiper plug 10 is inserted within the liner sleeve 22. This causes the upper and lower annular lips 40, 42 to exert a sealing force on the inner bore 48 of the liner sleeve 22.

OPERATION

As is well known in the art, the wiper plug 10 and a liner sleeve 22 can be releasably assembled on a work string 24, and held in place thereon by a setting tool (not shown). The setting tool can attach either the wiper plug 10 or the liner sleeve 22 to the work string 24. In the present invention, when the wiper plug 10 is assembled onto the work string 24, the lower end 30 of the work string 24 passes through the internal bore 14 of the wiper plug 10. This holds the flapper valve 18 in the upright, or open, position shown in FIG. 1. This readies the apparatus for installation in a well bore, with the flapper 18 held within the recess 46. With the structure shown, this requires positioning the flapper valve 18 in the open position before inserting the work string 24 through the internal bore 14. As discussed above, other flow control devices could also be used, and positioned to stay in the open position while assembled on the work string 24. When the liner sleeve 22 is assembled onto the work string 24 with the wiper plug 10, the upper and lower annular lips 40, 42 of the compressible seal 38 are flexed inwardly by contact with the inner bore 48 of the liner sleeve 22.

When thus assembled, the apparatus can be run into the well, and the liner sleeve 22 positioned as desired. The liner sleeve 22 and the liner wiper plug 10 are then set in place and released from the work string 24 by operation of a setting tool of conventional design. Alternatively, the liner wiper plug 10 alone could be run into the well on the work string 24, and landed in the liner sleeve 22. At this point, the apparatus would have the configuration illustrated in FIG. 1, with the flapper valve 18 in the open position, and with the work string free to move within the internal bore 14 of the wiper plug 10. In this configuration, fluid can be pumped downhole through the internal bore 14, via the work string 24.

When it is desired to plug the internal bore 14 of the wiper plug 10, the work string 24 is raised to a height sufficient to withdraw the lower end 30 of the work string 24 from the internal bore 14 until the flapper valve 18 can close, as shown in FIG. 2. Actual closing of the flapper valve 18 is accomplished by the force of gravity, or it can be assisted by a spring 60 as shown in FIG. 4. When the flapper valve 18 closes, it comes to rest and seals against the wall 54 of the internal bore 14. In addition, as shown in FIG. 4, a seat 56 on the lower edge of the recess 46 can contact a sealing chamfer 58 on the underside of the flapper valve 18. This prevents flow of fluid through the internal bore 14.

Then, fluid is pumped from the surface down through the work string 24, pressurizing against the upper side of the wiper plug 10 and the flapper valve 18. The pressure is built up until the combined shear strength of the shear pins or break-off lugs 20 is exceeded, and the pins or lugs 20 shear. This allows the wiper plug 10 to proceed down through the liner sleeve and the liner, as shown in FIG. 3. As the wiper plug 10 passes through the liner 22, the sealing element 16 seals between the wiper plug 10 and the liner, pushing one type of fluid in front, while the second type of fluid follows behind, segregated from the first type.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A liner wiper plug apparatus for use in pumping segregated fluids through a liner in a well bore, said apparatus comprising:

a liner wiper plug body;

a shearable support device connecting said plug body to a well bore liner, for releasably supporting said plug body from a well bore liner, said support device adapted to be sheared in use to release said plug body;

an internal bore through said plug body, said internal bore being sized and shaped to receive a hollow tubular work string therethrough;

a sealing element mountable on an external periphery of said plug body for sealing between said plug body periphery and a well bore liner; and a fluid flow control device mounted in said plug body, said flow control device being movable from an open position wherein said internal bore of said plug body is open, to a closed position wherein said internal bore is closed, said flow control device being arranged and constructed to be held in said open position when a work string is positioned in said internal bore of said plug body.

2. A liner wiper plug apparatus as recited in claim 1, wherein said flow control device is arranged and constructed to be held in said open position by contact with a work string, when the work string is in said internal bore of said plug body.

3. A liner wiper plug apparatus as recited in claim 1, further comprising a hollow tubular extension attachable to a work string, wherein said internal bore of said plug body is sized and shaped to receive said extension therethrough.

4. A liner wiper plug apparatus as recited in claim 1, wherein said fluid flow control device comprises a valve.

5. A liner wiper plug apparatus as recited in claim 4, wherein said valve comprises a flapper valve, said flapper valve being pivotable from said open position outside said internal bore of said plug body, to said closed position within said internal bore.

6. A liner wiper plug apparatus as recited in claim 1, further comprising a biasing device for biasing said fluid flow control device toward said closed position.

7. A liner wiper plug apparatus as recited in claim 6, wherein said biasing device comprises a spring.

8. A liner wiper plug apparatus as recited in claim 1, wherein said fluid flow control device is biased toward said closed position by the force of gravity.

9. A liner wiper plug apparatus as recited in claim 1, further comprising a releasable support device for releasably supporting said plug body in a well bore liner.

10. A liner wiper plug apparatus for use in pumping segregated fluids through a liner in a well bore, said apparatus comprising:

a liner wiper plug body;

an internal bore through said plug body said internal bore being sized and shaped to receive a hollow tubular work string therethrough;

a sealing element mountable on an external periphery of said plug body for sealing between said plug body periphery and a well bore liner, a fluid flow control device mounted in said plug body, said flow control device being movable from an open position wherein said internal bore of said plug body is open, to a closed position wherein said internal bore is closed said flow control device being arranged and constructed to be held in said open position when a work string is positioned in said internal bore of said plug body, and a releasable support device connecting said plug body to a well bore liner, for releasably supporting said plug body from a well bore liner;

wherein said releasable support device comprises at least one shear pin.

11. A liner wiper plug apparatus for use in pumping segregated fluids through a liner in a well bore, said apparatus comprising:

a liner wiper plug body;

an internal bore through said plug body, said internal bore being sized and shaped to receive a hollow tubular work string therethrough;

a sealing element mountable on an external periphery of said plug body for sealing between said plug body periphery and a well bore liner;

a fluid flow control device mounted in said plug body, said flow control device being movable from an open position wherein said internal bore of said plug body is open, to a closed position wherein said internal bore is closed, said flow control device being arranged and constructed to be held in said open position when a work string is positioned in said internal bore of said plug body; and a releasable support device connecting said plug body to a well bore liner, for releasably supporting said plug body from a well bore liner;

wherein said releasable support device comprises at least one break-off lug.

12. A liner wiper plug apparatus for use in pumping segregated fluids through a liner in a well bore, said apparatus comprising:

a liner wiper plug body;

an internal bore through said plug body, said internal bore being sized and shaped to receive a hollow tubular work string therethrough;

at least one shear pin extending from said plug body to connect said plug body to well bore liner, for releasably supporting said plug body from a well bore liner;

a compressible sealing element mountable on an external periphery of said plug body for sealing between said plug body and a well bore liner; and a flapper valve pivotably mounted in said plug body, said flapper valve being pivotable from an open position outside said internal bore of said plug body, to a closed position within said internal bore, said flapper valve being arranged and constructed to be held in said open position by a work string positioned in said internal bore of said plug body.

13. A liner wiper plug apparatus as recited in claim 12, wherein said flapper valve is biased toward said closed position by the force of gravity.

14. A method for pumping segregated fluids through a liner within a well bore, comprising:

providing a liner wiper plug, said liner wiper plug having an internal bore therethrough, said liner wiper plug having a fluid flow control device in said internal bore, and said liner wiper plug having a sealing element on an external periphery thereof;

positioning said liner wiper plug on a hollow tubular work string, with the work string within said internal bore of said liner wiper plug;

holding said flow control device in an open position wherein said internal bore of said liner wiper plug is open to fluid flow;

positioning said liner wiper plug in a well bore liner, with said sealing element sealing between said external periphery of said liner wiper plug and the interior surface of the well bore liner;

pumping a first fluid through the work string and through said liner wiper plug;

withdrawing the work string from said liner wiper plug;

moving said flow control device from said open position to a closed position wherein said internal bore is closed to fluid flow; and pumping a second fluid through the work string to apply fluid pressure against said liner wiper plug, to move said liner wiper plug through the well bore liner with said first fluid segregated from said second fluid.

15. A method for pumping segregated fluids through a liner within a well bore, as recited in claim 14, further comprising:

releasably supporting said liner wiper plug from the well bore liner; and selectively releasing said liner wiper plug from the well bore liner to pass through the well bore liner, segregating said first and second fluids.

16. A method for pumping segregated fluids through a liner within a well bore, as recited in claim 15, further comprising:

providing at least one shear pin to releasably support said liner wiper plug from the well bore liner; and applying sufficient fluid pressure against said liner wiper plug to shear said at least one shear pin to selectively release said liner wiper plug from the well bore liner.

17. A method for pumping segregated fluids through a liner within a well bore, as recited in claim 14, wherein said fluid flow control device comprises a flapper valve, and further comprising:

pivoting said flapper valve to said open position by positioning a work string within said internal bore of said liner wiper plug; and allowing said flapper valve to pivot to said closed position by withdrawing the work string from said internal bore of said liner wiper plug.

* * * * *